US012480739B2

(12) United States Patent
Engel

(10) Patent No.: US 12,480,739 B2
(45) Date of Patent: Nov. 25, 2025

(54) REPEATING FIREARM

(71) Applicant: Heinz-Eckhard Engel, Battenberg/Eder (DE)

(72) Inventor: Heinz-Eckhard Engel, Battenberg/Eder (DE)

( * ) Notice: Subject to any disclaimer, the term of this patent is extended or adjusted under 35 U.S.C. 154(b) by 58 days.

(21) Appl. No.: 18/631,552

(22) Filed: Apr. 10, 2024

(65) Prior Publication Data

US 2024/0377156 A1 Nov. 14, 2024

(30) Foreign Application Priority Data

May 9, 2023 (DE) ..... 10 2023 112 184.7

(51) Int. Cl.
*F41C 7/02* (2006.01)
*F41A 3/20* (2006.01)

(52) U.S. Cl.
CPC . *F41C 7/02* (2013.01); *F41A 3/20* (2013.01)

(58) Field of Classification Search
CPC .. F41C 7/02; F41A 15/14; F41A 17/46; F41A 3/26; F41A 3/20; F41A 3/72; F41A 17/76; F41A 19/13; F41A 19/27; F41A 19/47
USPC ..... 42/16, 17, 71.01, 75.01, 10, 19
See application file for complete search history.

(56) References Cited

U.S. PATENT DOCUMENTS

| | | | | |
|---|---|---|---|---|
| 398,063 | A | 2/1889 | Mauser | |
| 1,613,205 | A * | 1/1927 | Soncini | F41A 3/26 89/174 |
| 2,214,071 | A * | 9/1940 | Swebilius | F41A 3/24 42/75.01 |
| 2,422,532 | A | 6/1947 | Dehm | |
| 2,832,165 | A | 4/1958 | Ivy | |
| 5,575,101 | A | 11/1996 | Piccini | |
| 7,467,581 | B2 | 12/2008 | Botty | |
| 7,526,887 | B2 | 5/2009 | Engel | |
| 8,800,422 | B2 * | 8/2014 | Norton | F41A 15/14 89/185 |
| 2005/0229460 | A1 * | 10/2005 | LaFleur | F41A 9/50 42/69.03 |
| 2014/0059910 | A1 | 3/2014 | Norton et al. | |
| 2015/0089854 | A1 | 4/2015 | Findlay | |
| 2019/0212801 | A1 | 7/2019 | Cox | |

FOREIGN PATENT DOCUMENTS

| | | |
|---|---|---|
| AT | 2715 | 11/1900 |
| AT | 71620 | 6/1916 |
| CH | 1613 | 2/1890 |
| CH | 7667 | 5/1894 |
| DE | 106939 | 7/1896 |
| DE | 4305700 | 10/1994 |
| DE | 20000158 | 5/2000 |
| DE | 20100014 | 5/2001 |
| DE | 20200600661 | 9/2007 |
| EP | 0692696 | 1/1996 |
| GB | 132889 | 9/1919 |
| GB | 756769 | 9/1956 |

* cited by examiner

*Primary Examiner* — Michael D David
(74) *Attorney, Agent, or Firm* — Lipsitz & McAllister, LLC

(57) ABSTRACT

The invention relates to a repeating firearm, in particular a repeating rifle, which is configured as a straight-pull bolt action rifle, comprising a forestock and a bolt handle. The repeating firearm is selectively operable either with the forestock or with the bolt handle.

12 Claims, 10 Drawing Sheets

REPEATING FIREARM

This application claims the benefit of German application number 10 2023 112 184.7 filed on May 9, 2023, which is incorporated herein by reference in its entirety and for all purposes.

SUBJECT MATTER OF THE INVENTION

The invention relates to a repeating firearm, in particular a repeating rifle, which is configured as a straight-pull bolt action rifle, comprising a forestock and a bolt handle.

PRIOR ART AND ITS DISADVANTAGES

With the invention of cartridge ammunition, handguns (pistols and revolvers) and long guns (rifles and shotguns), after their historic era as muzzle-loaders, changed into breech-loaders. This triggered an avalanche of development, which resulted both in so-called multi-loaders with their associated cartridge magazines, as well as breechblocks in a wide variety that can hardly be overlooked.

The task of breechblocks for firearms is basically to mechanically securely close the tube open for loading at the rear, the barrel, when shooting. In addition to breechblocks for semi-automatic and fully automatic weapons, which among other things use the mass inertia of breechblock elements, the most common breechblock technology for rifles for civil, official, and sporting use was and still is rigidly locking breechblocks, which are typically operated by hand.

For long guns, which are designed for bullet ammunition and are referred to as rifles (versus shotguns for shot ammunition), the bayonet-like, manually rotatable cylinder breechblock has prevailed, which not only solidly locks the barrel (though often indirectly by way of the system housing bearing the barrel), but with its linear movement component also serves to eject the spent cartridge case and to feed a new cartridge from said cartridge magazine. This process is called repeating and thus the associated rifles for bullet ammunition are referred to as repeating rifles and the corresponding design for shotgun ammunition as repeating shotguns.

For manually handling the (rotating) cylinder breechblock (bolt action)—also referred to as the chamber—it is equipped with a bolt handle that extends transversely to the cylinder axis, which cylinder axis coincides with the barrel axis, the free end of said bolt handle bearing an easily operable handle ball, as is widely used in millions of instances for handling machines (and machine elements).

When handling this type of design according to, for example, AT 2715 B and U.S. Pat. No. 398,063 A, the so-called shooting hand that grips the rifle stock by its pistol grip (formerly called the stock wrist), which lies between the buttstock and forestock, must release it, grasp the ball grip, handle it for repetition, and then grasp the pistol grip again and place the trigger finger (carefully) on the trigger. This is time-consuming and not infrequently too slow for rapid follow-up shots—as they are necessary, for example, in so-called driven hunting, hunting searches, or in biathlon shooting.

This is why designs were devised quite early on with the elimination of the manual rotary motion component, for example according to CH 1613 A, CH 7667 A, AT 71 620 B, and DE 106 939 A, wherein the kinematics of the breechblock head guided in a helical groove are similar to that of a historical drill. Significantly, the term "straight-pull action" is already used in the old documents, which became the name for the "straight-pull bolt action rifle", which have only matured in recent decades and are now offered by almost all well-known hunting gun manufacturers. This type of construction with "linear action" ("pull/push action" or "straight pull"), as it is called in expert circles, has also taken its place among sport and sniper shooters.

Nevertheless, the disadvantage of this design—as with all repeaters with a bolt handle—is that for rapid repeating, the above-described, time-consuming replacement of the grip from the pistol grip to the bolt handle ball and vice versa is unavoidable. This is compounded by the fact that buttstocks are increasingly configured as so-called thumbhole stock. Here, the stock hole acts as a thumbhole, which allows a relaxed firing position, but is ergonomically cumbersome due to the removal and insertion of the thumb.

This disadvantage is circumvented by another type of construction, which is particularly common in the USA, the so-called pump action repeater. This is well established as a rifle—for example according to EP 0 692 696 B1—or shotgun—for example according to GB 756 769 A—and is predestined for rapid consecutive shots, which are usually fired while standing, because both hands can remain on the firearm while repeating, and the firearm does not have to be taken out of the (free-standing) firing position. For repeating, the so-called guide hand moves the forestock back and forth in parallel to the barrel and thereby drives the linear action by way of a linkage.

A major disadvantage of this design is the need to lift the weapon for repetition when shooting the follow-up shot on a hunting or sporting stand, or when shooting from the prone position, so that the forestock can be oscillated linearly with the guide hand.

In order not to have to carry a bolt action rifle with a bolt handle and thumbhole stock for stand hunting and a pump action repeater for driven hunting and battue, but instead to enable the hunter to use the weapon with which they are familiar in terms of firing position and trigger action for both types of hunting, based on the straight-pull repeater Model R93 from the manufacturer Blaser according to DE 43 05 700 C1, it was attempted with a connecting rod-like retrofit kit according to the documents DE 200 00 158 U1 and DE 201 00 014 U1 to be able to use the straight-pull repeater as a pump action repeater as required. As well as the approach was intended, it failed miserably—apart from the aesthetics that took some getting used to—mainly because of the significant disadvantage that the attachment had to be mounted by the hunter, mostly outdoors, and the necessary accessories had to be carried along.

In addition to the repeater with a cylinder breechblock (bolt action) and the forestock repeater (pump action), there is also the lever repeater (lever action), referred to colloquially as the "Winchester rifle", which could not prevail over the other two types but had its place especially in the "Wild West", when shooters had to repeat on horseback with one hand.

The disadvantages described seem to be surmountable with a semi-automatic rifle, for example according to U.S. Pat. No. 7,467,581 B2. However, on the hunt, it is ethically frowned upon and legally banned in some countries, or—at least in Germany—its magazine capacity is limited to only 2 cartridges. This reduces its suitability for driven hunting, specially for which driven hunting magazines with high cartridge capacities for repeating rifles are offered. In addition, this design does not match the shooting precision of bolt action rifles, so it is not suitable for long-range shooting with the weapon supported shooting from a stand. There are two technical reasons for this: On the one hand, in the case of (semi-) automatic weapons, after firing the shot and before the projectile has left the barrel, the breechblock mechanism is in motion and the vibration thereof has an effect on the entire weapon. On the other hand, in the most predominant kind of autoloaders, the so-called gas-operated weapons, the energy required for the autoloading process is diverted through a transverse bore of the barrel. Since this is arranged not far from the barrel mouth, as shown in FIGS. 2 and 8 to 11 of document U.S. Pat. No. 7,467,581 B2, the apparatus used for gas discharge and the autoloading process hinders the free oscillation of the barrel, which is essential for a high shooting precision.

Another reason that speaks against a (semi-automatic) autoloader is its dependence on ammunition loads and weapons accessories, such as muzzle brakes and—now hunting approved—silencers. Lastly, its unreliability in the case of so-called "failures" is disadvantageous: Once a cartridge fails to fire, no reloading takes place. These disadvantages are foreign to a repeating rifle and are not acceptable for dangerous use cases, such as hunting. Similarly, for this very reason, in the case of handguns, the autoloading pistol will not be able to supersede the revolver, which is immune to loading malfunctions.

U.S. Pat. No. 2,422,532 A, GB 132,889 A, US 2019/0212081 A1, and U.S. Pat. No. 2,832,165 A reveal repeating firearms, which are selectively operable either with the forestock or with the bolt handle.

OBJECT OF THE INVENTION

The object of the invention is to overcome the described disadvantages of the prior art and to create a repeating firearm, in particular a repeating rifle, which is operable in a versatile and ergonomic manner.

BRIEF DESCRIPTION OF THE INVENTION

One aspect of the invention relates to a repeating rifle according to claim 1. The invention allows the shooter to operate the same repeating firearm, depending on the specific situation, using the repeating mechanism that is more advantageous in this respective situation, in particular from an ergonomic point of view.

In accordance with the invention, a switching between the operation with the forestock and the operation with the bolt handle takes place in a toolless manner by way of at least one actuating handle arranged on or in the repeating firearm.

Switching between the two operating modes is therefore very fast and simple for the shooter. It is particularly favorable if an actuating handle is attached to or in the forestock or housing of the repeating firearm on both sides (for left-handed and right-handed shooters). The concrete embodiment of the actuating handle can be based on the design that has proven itself millions or times, which is implemented, e.g., in switches of hand drills for switching from clockwise to counterclockwise rotation. In particular, the at least one operating handle may be configured as a push-button switch, a toggle switch, a rocker switch, a rotary switch, or a pendulum switch.

The at least one actuating handle has a two-stage switching mechanism with a first switching state and a second switching state (in its end positions determined by stops). The switching mechanism may hereby be completely or partially hidden by the forestock. Thus, in the first switching state (i.e. in the one position of the actuating handle), the straight-pull repeater can be handled as a pump action repeater, while in the second switching state (i.e. in the other position of the actuating handle) the operation takes place by way of the bolt handle, with the forestock axially fixed.

Further preferred embodiments of the repeating firearm in accordance with the invention result from the dependent claims.

BRIEF DESCRIPTION OF THE DRAWINGS

Further features, details, and advantages of the invention—which may also be relevant to the invention in a combination not explicitly mentioned—are explained in more detail using the following embodiments with reference to the drawings.

In the drawings.

DETAILED DESCRIPTION OF THE INVENTION

Figure 1:
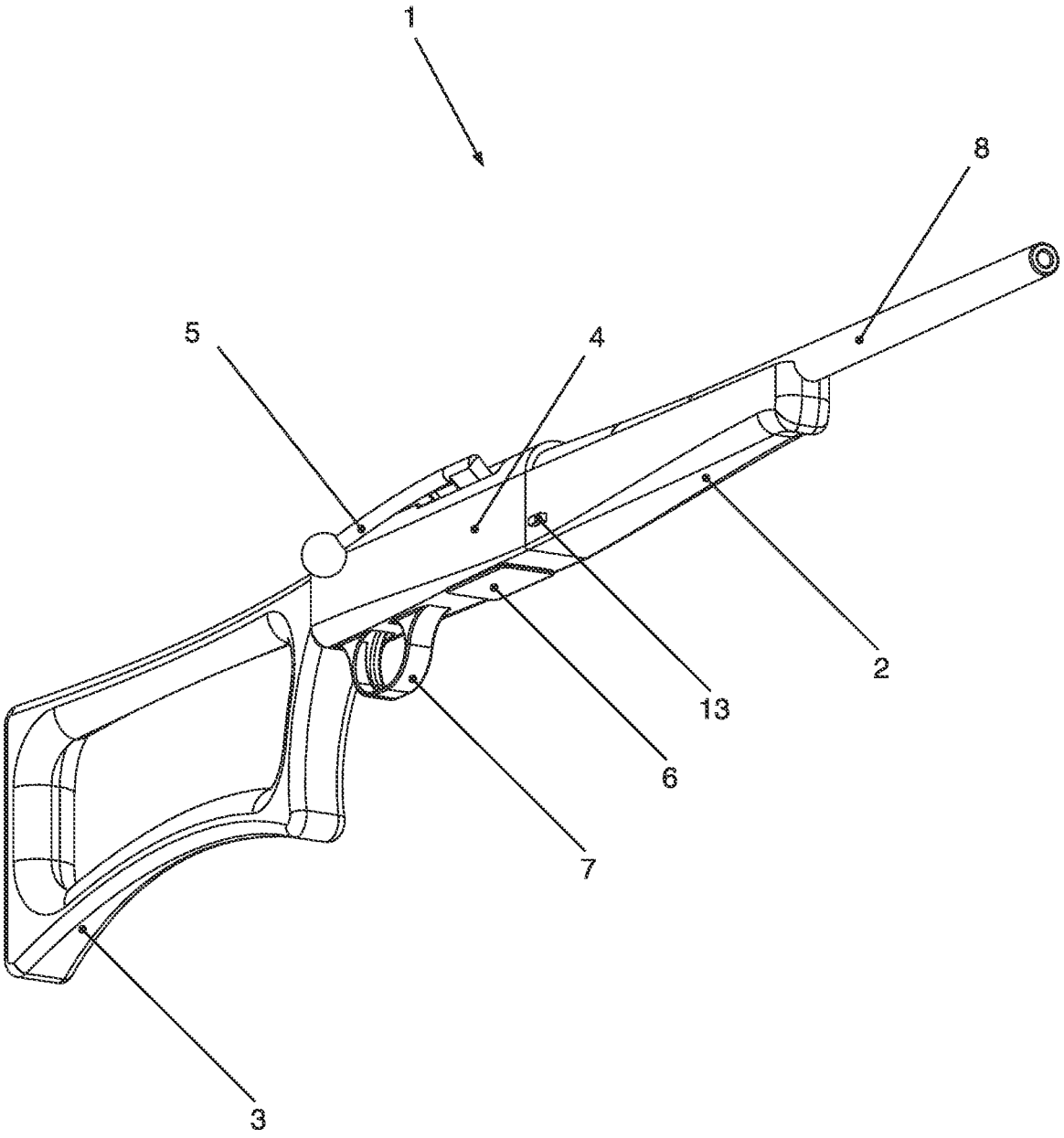
FIG. 1: shows a perspective bottom view of a straight-pull bolt action rifle with the breechblock closed, comprising a buttstock, forestock, and housing into which a plug-in magazine and a trigger assembly are inserted.

Depicted in FIG. 1 is a repeating rifle, denoted by 1, according to a first embodiment of the invention, the linear action of which (with a breechblock head located thereon in the firing direction) allows the operation as a straight-pull bolt action repeater. For this purpose, the breechblock, longitudinally guided in a housing 4 arranged between the forestock 2 and buttstock 3, is provided with a bolt handle 5, at the free end of which a handle ball is attached for comfortable repeating. A cartridge magazine 6 and a trigger assembly 7 are inserted in the housing 4, and a barrel 8 is arranged at the front end face of said housing.

The forestock 2 is passed through transversely to the barrel axis by an actuating handle 13, which is axially displaceable, is arranged in a rotationally-fixed manner, and is configured as a sliding switch 13, the two end faces of which are mirror-symmetrically opposite one another and are operable as push-buttons (with a left and a right end position). With these, the repeating rifle 1 can be switched between the two operating modes "repeating by means of bolt handle" and "repeating by means of forestock".

Figure 2:
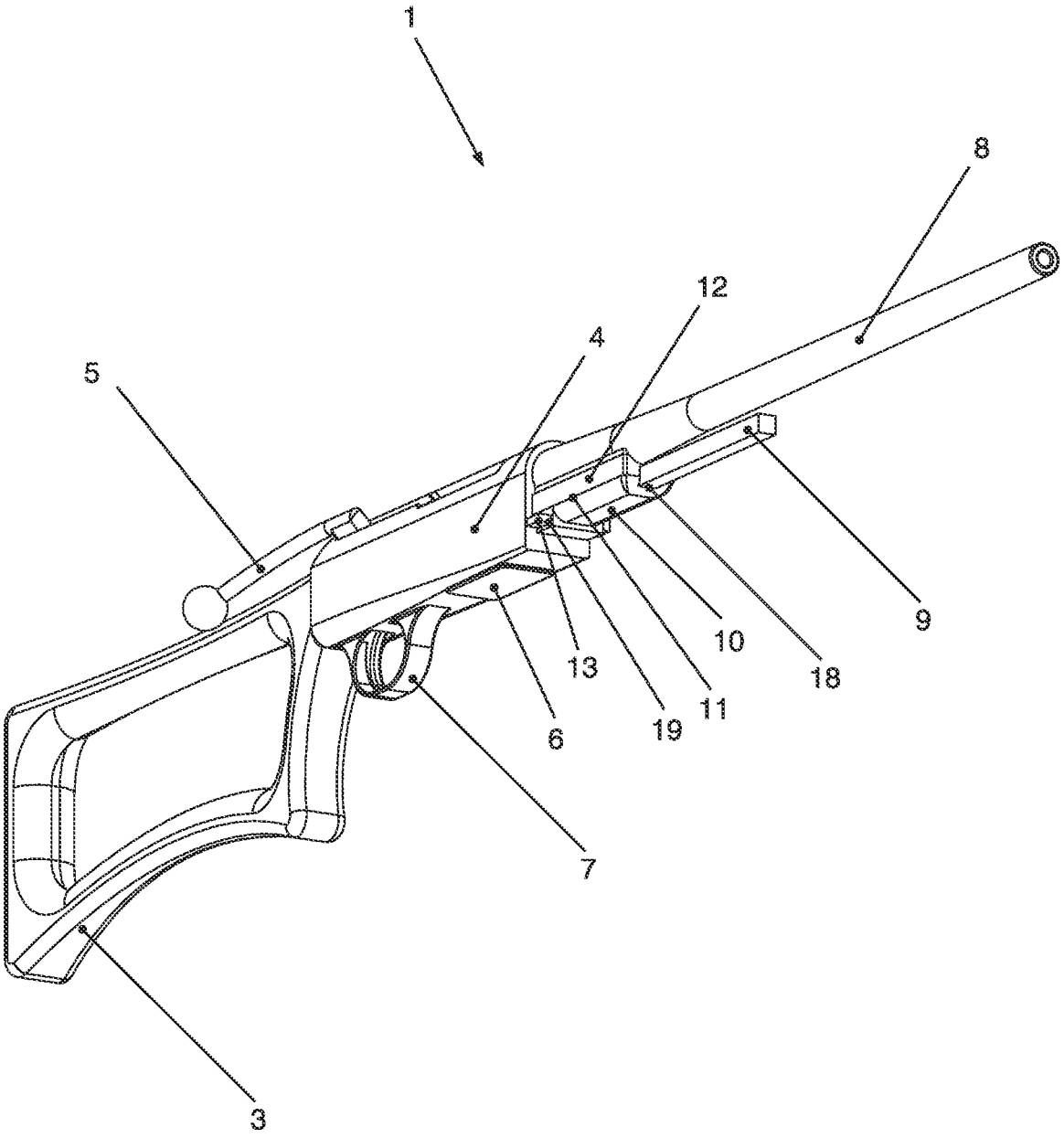
FIG. 2: similar to FIG. 1, but with the breechblock open and without a forestock, comprising a longitudinal guide, a slide located thereon, an actuating handle located therein and configured as a sliding switch, and lateral actuating bars.

In FIG. 2, the forestock 2 is removed, such that a longitudinal guide 9 becomes visible, said longitudinal guide being configured as a rectangular rod 9 in parallel to the barrel and being fixed to the housing 4 on the end face with a largely mirror-symmetrical slide 10 that is mounted on the longitudinal guide in an axially displaceable and rotationally-fixed manner. For this purpose, the slide 10 is provided with a preferably square longitudinal perforation 18. Perpendicular to said longitudinal perforation, the slide has a shaft-like transverse perforation 19 for longitudinally guiding the sliding switch in a rotationally-fixed manner. On its two side faces, the slide 10 is provided with mirror-symmetrical guide grooves 11 (or longitudinal perforations) for two actuating bars 12 (preferably of rectangular cross section), which are coupled to the linear breechblock in an axially-fixed manner. Alternatively, the at least one actuating bar 12 may be longitudinally guided only in the housing 4 or both in the housing 4 and in or on the slide 10.

The forestock 2 and the slide 10 form an assembly connected to one another in a mechanically rigid manner.

Figure 3:
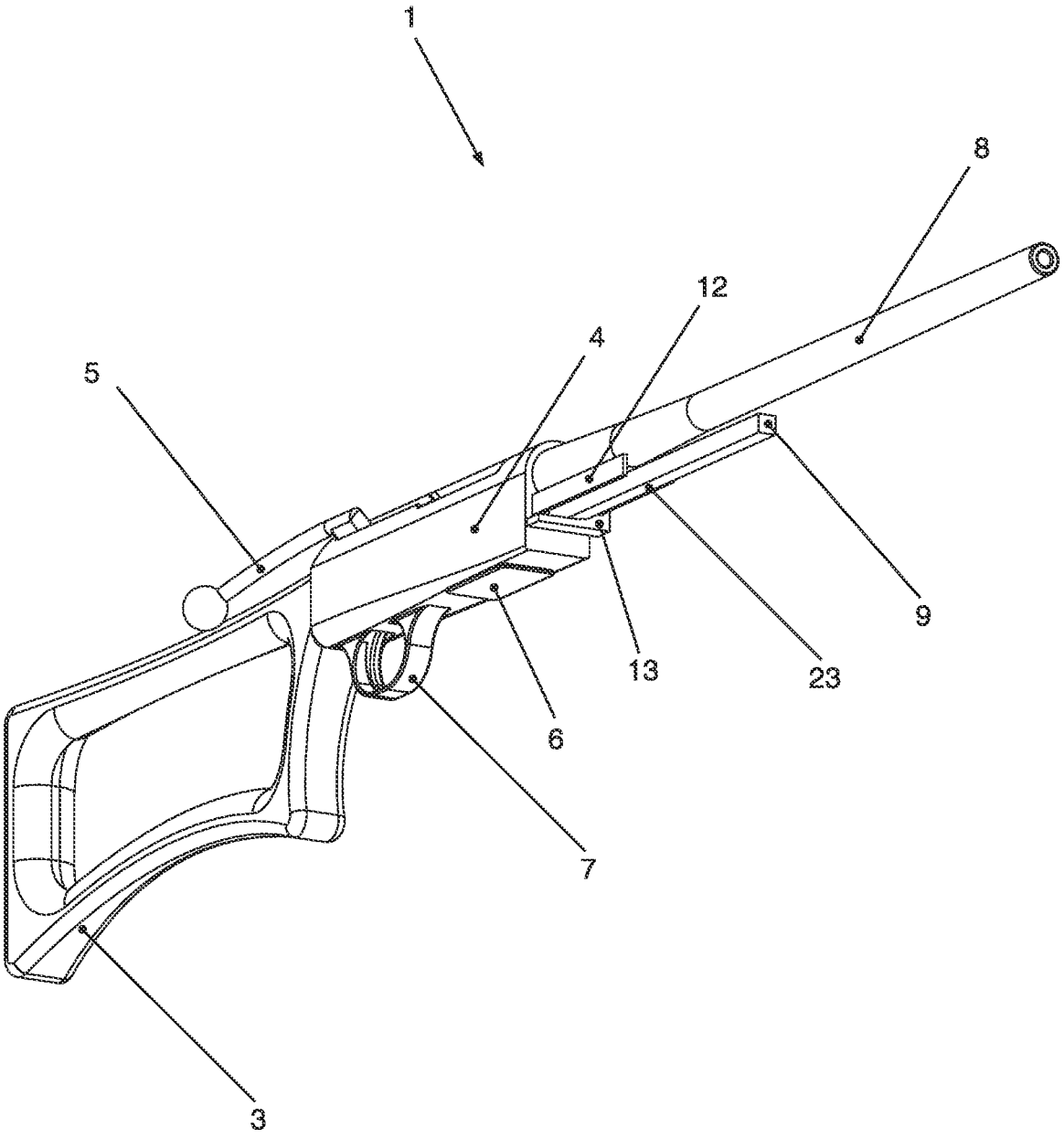
FIG. 3: similar to FIG. 2, but without a slide, comprising a sliding switch, in the operating mode by means of a bolt handle.

With the slide 10 removed, FIG. 3 shows the longitudinal guide 9 with a polygonal profile, as the aforementioned rectangular rod. It is preferably stationarily arranged as a cantilever on the housing 4 below the barrel 8 and substantially in parallel thereto (said barrel also being stationarily arranged on the housing 4). Since the slide-forestock-assembly 2, 10 is arranged on said cantilever (so as to be longitudinally movable) and is not in mechanical contact with the barrel 8, the cantilever can vibrate freely in a way that is conducive to shooting precision.

The straight-pull breechblock not depicted here is guided in the housing 4 so as to be longitudinally movable and is coupled, preferably in a positive-locking manner, to at least one of the two actuating bars 12 in an axially-fixed manner.

Figure 4:
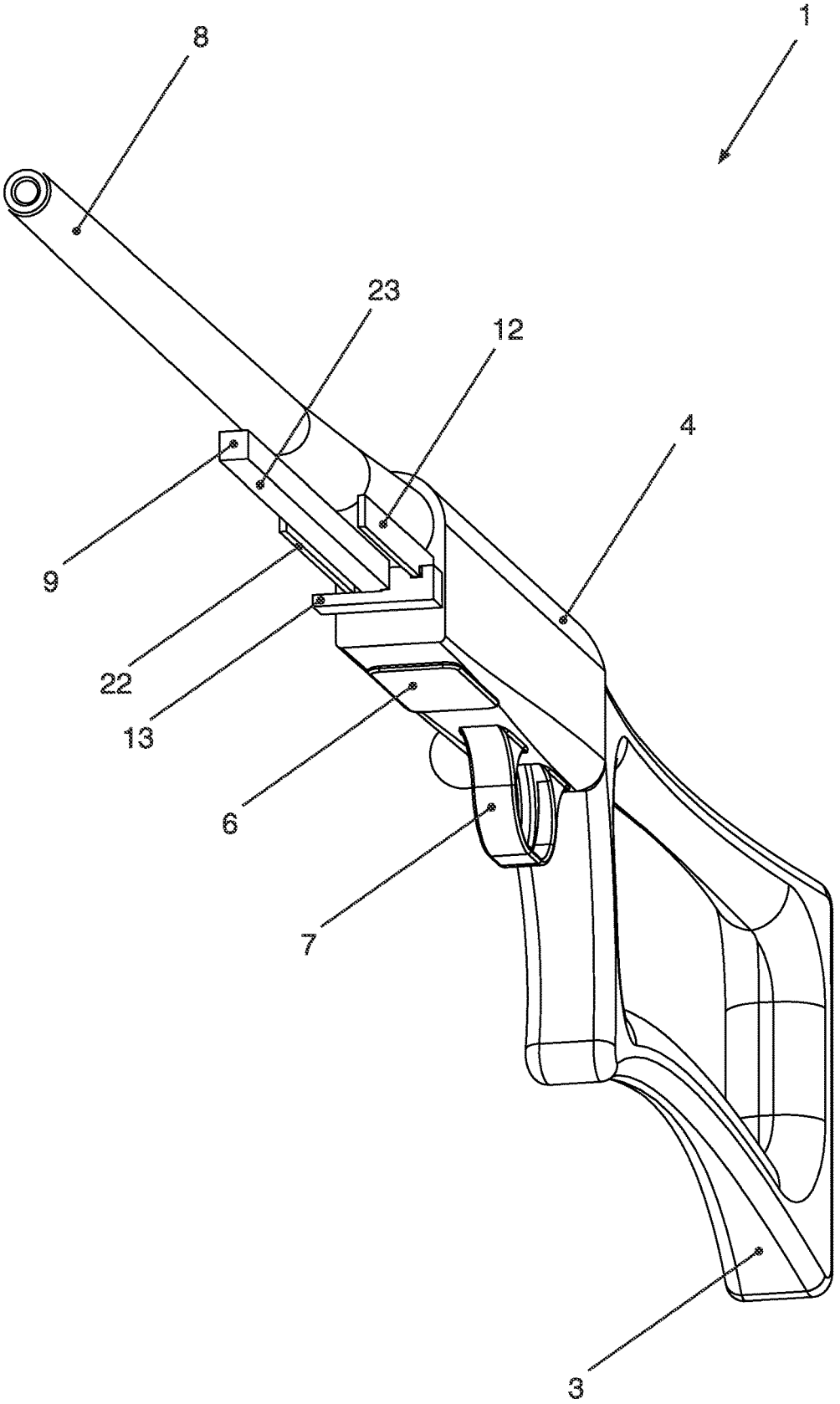
FIG. 4: similar to FIG. 3, but from an opposite perspective.
Figure 5:
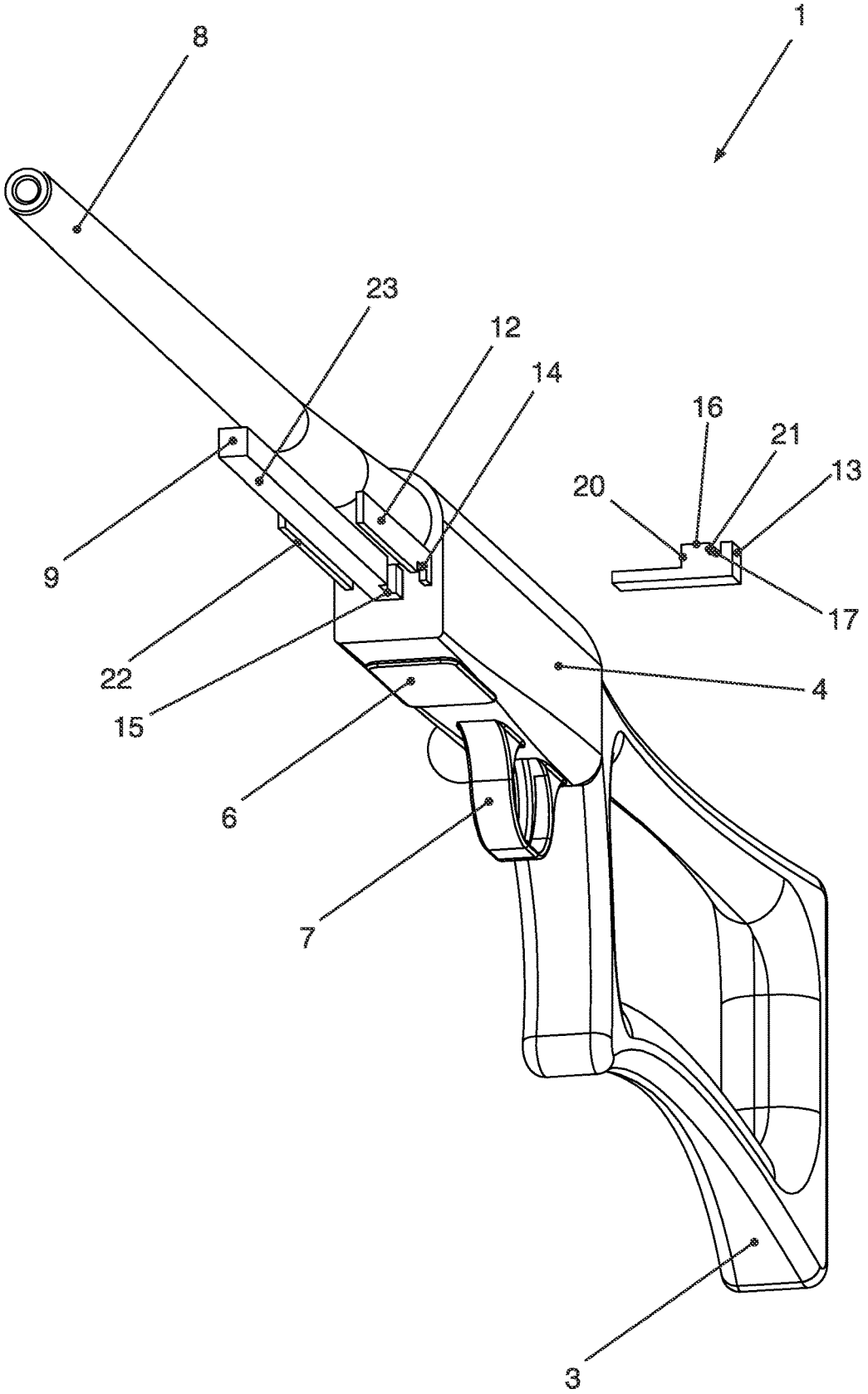
FIG. 5: similar to FIG. 4 with a sliding switch depicted separately.
Figure 6:
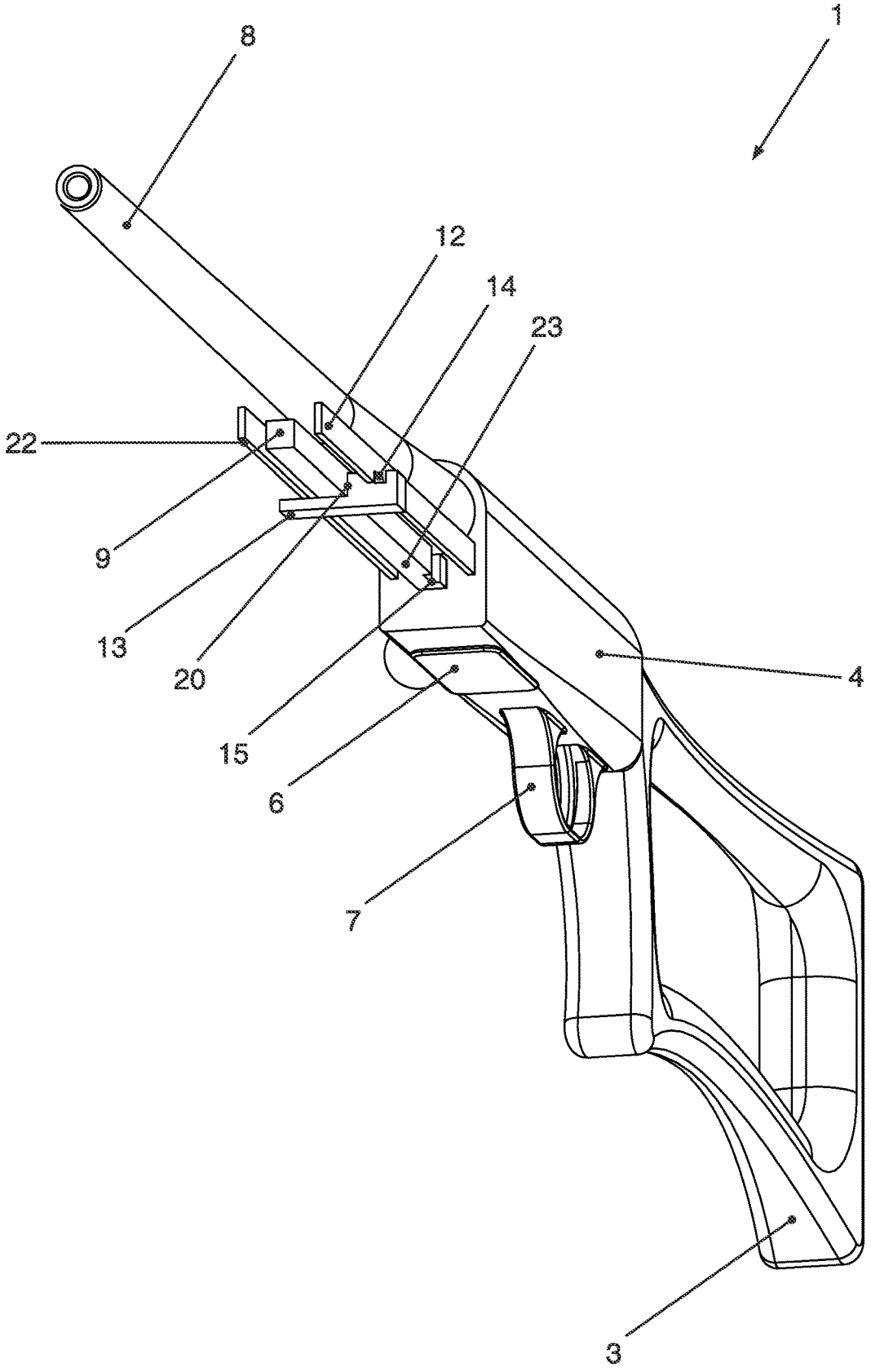
FIG. 6: similar to FIG. 4, but in the operating mode as a pump action repeater with a closed breechblock.

FIG. 3 to FIG. 6 disclose the compact and user-friendly switching mechanism, the sliding switch 13 of which comes into engagement either with the rectangular rod 9 (according to FIG. 4) or the actuating bar(s) 12 (according to FIG. 6) by said sliding switch being actuating in the manner of a push-button on its left or right end face. For this purpose, the latter 12 according to FIG. 5 is/are provided with at least one gap-like cut-out 14, and the rectangular rod 9 is provided with a vertical transverse groove 15.

In order to achieve a bolt-like positive engagement, the sliding switch 13 according to FIG. 5 is provided with a cuboidal locking projection 16, which on its side pointing away from the rectangular rod transitions into a groove-like locking set-back portion 17, which terminates with an end-face cross section in the outline of the locking projection 16.

On its side pointing toward the rectangular rod 9, the locking projection 16 is stepped. From here, the sliding switch 13 has a flat cross section, which according to FIG. 1 protrudes transversely out of the forestock 2 like a push-button. This shape of the sliding switch 13 provides in both its directions of movement locking noses 20, 21 on both sides of the locking projection 16, which serve to axially lock the slide 10 and thus the forestock 2 (see FIG. 5).

For the operating mode with the bolt handle 5 according to FIG. 1 to FIG. 3, according to FIG. 4 and FIG. 5 the groove-side locking nose 20 of the locking projection 16 comes into engagement with the vertical transverse groove 15 of the rectangular rod 9 and out of engagement with the gap-side portion 14 of the actuating bar(s) 12 with its opposite locking nose 21. The slide 10 with the forestock 2 attached thereto is thereby axially locked on its longitudinal guide 9 and the forestock 2 is thus fixed to the housing 4 in an axially-fixed manner. When actuating the bolt handle 5, the two actuating bars 12 slide unhindered in the guide grooves 11 of the slide 10 (or laterally past said slide 10) and thereby pass through the groove-like locking set-back portion(s) 17 according to FIG. 4 and FIG. 5.

After displacing the sliding switch 13 into the opposite end position by ergonomically comfortably pressing it from its end face projecting out of the forestock 2 (see FIG. 1), it is exactly the opposite: In this position of the sliding switch 13, according to FIG. 6, its groove-side locking nose 20 has now come out of engagement with the vertical transverse groove 15 of said locking nose 20 and its gap-side locking nose 21 has come into engagement (with the gap 14) with at least one of the two actuating bars 12. An axial connection of the slide 10 to the actuating bar(s) 12 is thus established in a positive-locking manner and is released from the rectangular rod 9. The firearm 1 can thus now be operated as a pump action repeater, the forestock 2 driving the linear breechblock (in the same direction) and the bolt handle 5 fixed thereto being moved uselessly back and forth therewith. This does not interfere mechanically and ergonomically, but it may be removed for aesthetic reasons.

Figure 7:
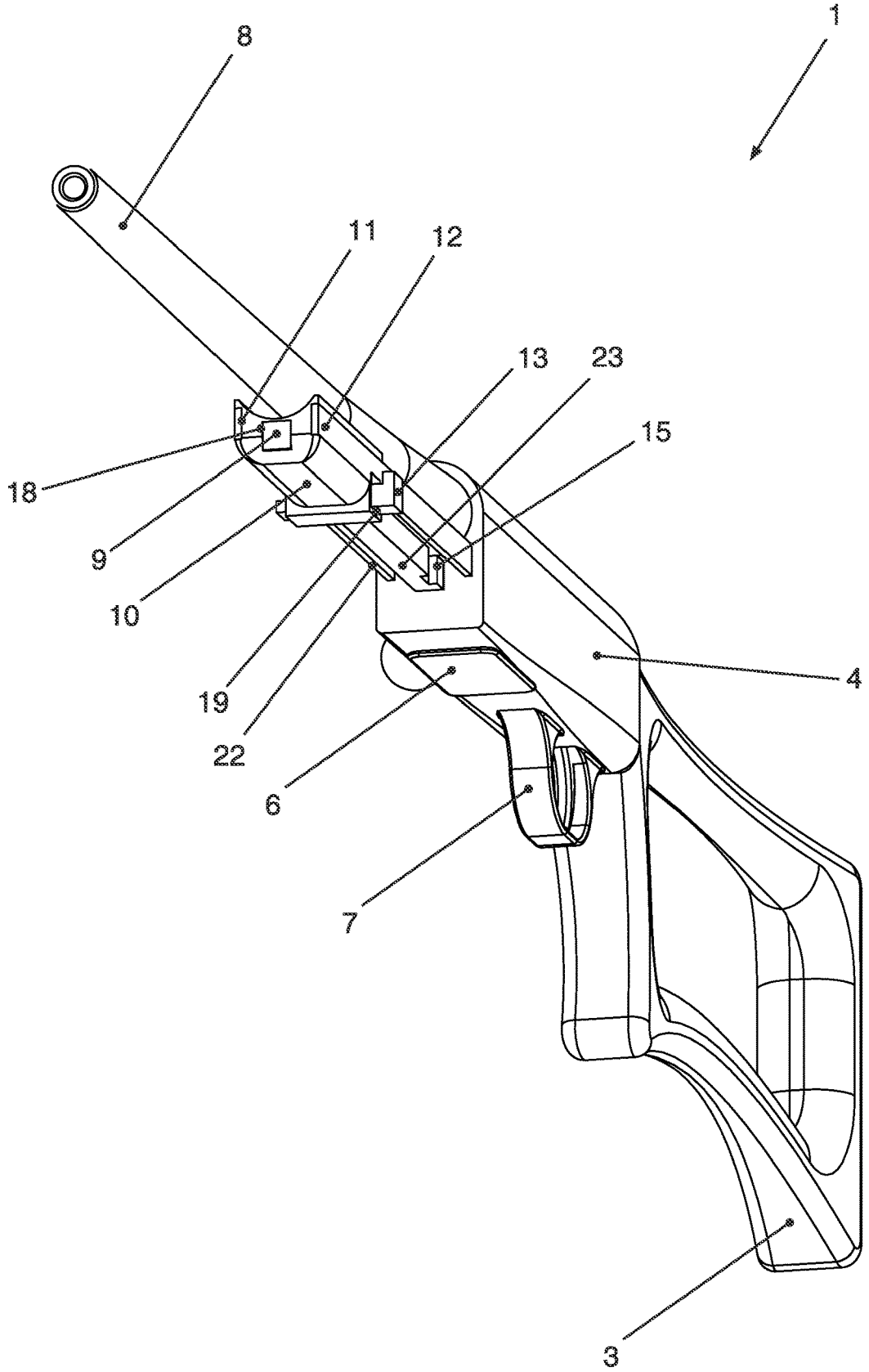
FIG. 7: similar to FIG. 6, but with a slide.
Figure 8:
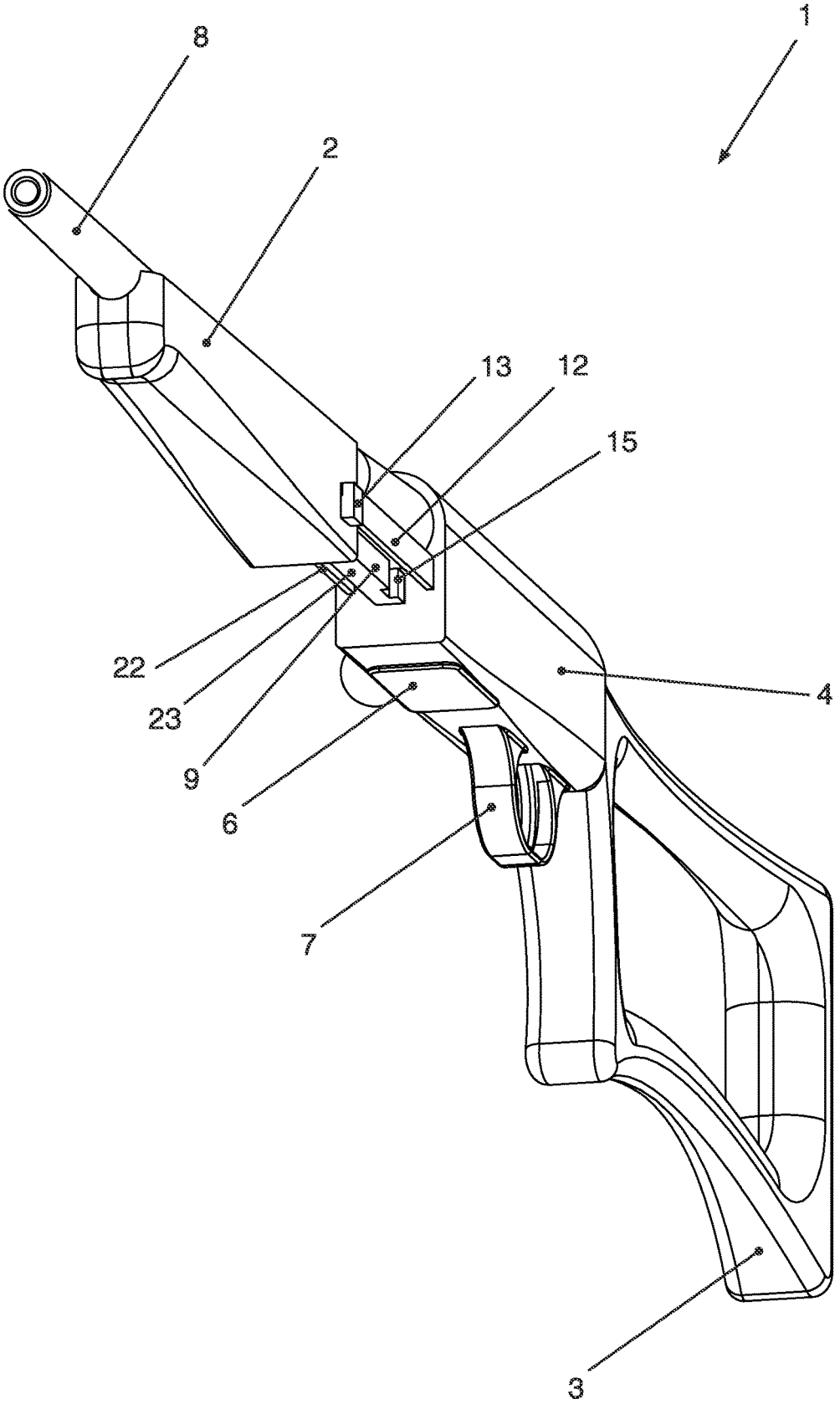
FIG. 8: similar to FIG. 7, but with a forestock.

FIG. 7 shows this operating mode with the breechblock closed with the slide 10 and FIG. 8 with the forestock 2 attached thereto in the front end position of said forestock 2. The market accepts the hand-wide "gap" that exists here between the forestock 2 and housing 4, even if it is concealed here and there with forestock extensions projecting to the rear in a U-shape. This is counteracted by the present invention in the operating mode with the bolt handle 5, which is presumably predominantly used: In FIG. 1 and FIG. 2, the slide 10 is located in its rear end position locked to the longitudinal guide 9 by the sliding switch 13, the forestock 2 transitioning flush into the housing 4 in a stylish manner.

The design of the sliding switch 13 with its latching noses 20, 21 on both sides, and the arrangement of the corresponding gap 14 or groove 15 arranged in alignment with said sliding switch 13, which gap 14 or groove 15 is arranged transversely to the barrel axis according to FIG. 5, allow for switching between the two described operating modes only when the breechblock is completely open. This switching logic has 3 advantages:

1. There is no cartridge in the barrel, so no unintentional shot can be fired when switching.
2. When the weapon 1 is loaded and possibly even ready to fire, the sliding switch 13 is automatically secured against displacement, so that the set operating mode cannot be changed unintentionally.
3. For the shooter, the two switching positions are clear, so that it is easy to learn and, after some practice, the weapon 1 can be intuitively controlled. To this end, it appears plausible to let the end face of the sliding switch 13 protrude on the side of the bolt handle in the operating mode with the bolt handle 5.

According to FIG. 5, the sliding switch 13, as mentioned, is stepped at the groove-side locking nose 20 and extends from here with its flat cross section up to its end face. This cross sectional profile allows for easy assembly with an open breechblock through the entire firearm 1. Here, the sliding switch 13 first passes a corresponding shaft in the forestock 2, then passes through the cross sectionally identical transverse perforation 19 of the slide 13, before it emerges with its end face out of the forestock 2 through a shaft of a small cross section. This end position is formed in a mechanically elegant manner by the groove-side locking nose 20 striking on the groove base of the vertical transverse groove 15 and thus ensures the maximum positive engagement between the longitudinal guide 9 and the sliding switch 13 and thus with the slide 10 and hence also on the forestock 2 fixed thereto.

In both end positions, the sliding switch 13 is secured in position by a spring catch and can be pushed out of the forestock 2 laterally—for example with a screwdriver blade—when the breechblock is open. The forestock-slide-assembly 2, 10 can then be removed in the firing direction, for example for cleaning the weapon.

As an alternative to the locking noses 20, 21, a round pin may be arranged on at least one of the two end faces of the locking projection 16, the axis of which round pin extends in the direction of movement of the sliding switch 13. The one engages into a corresponding transverse bore of the rectangular rod 9 and the other engages into a through-bore of the actuating bar(s) 12, which can be produced economically as a punched hole.

Nevertheless, at least one raised form that is arranged on the sheet metal strip(s) 12 and is economically producible by forming technology (e.g. bent sheet metal flap) can come into or out of positive-locking engagement with a corresponding recess of the locking projection 16.

In another embodiment, which is not graphically illustrated here, the sliding switch 13 described above is configured as an axially-fixed and rotatable switching shaft. It is rotatably mounted in an axially-fixed manner in a transverse bore, in a similar position as the transverse perforation 19, of the slide 10 and corresponds to recesses in the actuating bar(s) 12 and the rectangular rod 9, which recesses, when the breechblock is open, are congruent transverse to the barrel axis and are preferably of semi-circular cylindrical configuration, or of prismatic or V-shaped configuration. For this purpose, the lower side faces 22 of said bars 12 and the lower side face 23 of the rectangular rod 9 structurally form a plane in which (or in a plane parallel thereto) the axis of said switching shaft lies. The switching shaft is configured as a circular cylinder that can be manually rotated (from the outside by means of a rotary handle/rotary handles).

While the two half-shaft cross sections in the region of the actuating bars 12—viewed axially—are congruent, the half-shaft corresponding to the rectangular rod 9 is rotated by 180° compared to those two of the actuating bars 12. Thus, in the operating mode as a repeating rifle with the drive by way of the bolt handle 5, the switching shaft with its central half-shaft is in engagement with the rectangle 9 and out of engagement with the half-shaft pair of the actuating bar pair 12: The slide is thereby axially locked on its longitudinal guide 9 and thus the forestock 2 is locked to the housing 4 in an axially-fixed manner. Upon actuating the bolt handle 5, the two actuating bars 12 slide unhindered along the guide grooves 11 of the slide 10 and past their half-shaft cross sections.

After rotating the switching shaft by 180°, it is exactly the opposite: In this angular position, the switching shaft is now in engagement with the two actuating bars 12 and is decoupled from the rectangular rod 9: An axial connection of the slide 10 to the actuating bars 12 is thus established in a positive-locking manner and is released from the rectangular rod 9. The firearm 1 can thus now be operated as a pump action repeater, the forestock 2 driving the linear breechblock (in the same direction) and here, too, the bolt handle fixed thereto being moved uselessly back and forth therewith.

The described design of the switching shaft, as well as the positions of the corresponding rectangular and actuating rod/bar(s) 9, 12 allow switching between the two described operating modes described only when the breechblock is completely open. This has the same 3 advantages as mentioned above:

1. There is no cartridge in the barrel, so no unintentional shot can be fired when switching.
2. When the weapon 1 is loaded and possibly even ready to fire, the switching shaft 13 is automatically secured against rotation, so that the set operating mode cannot be changed unintentionally.
3. For the shooter, the two switching positions are clear, so that it is easy to learn and, after some practice, the weapon 1 can be intuitively controlled.

Figure 9:
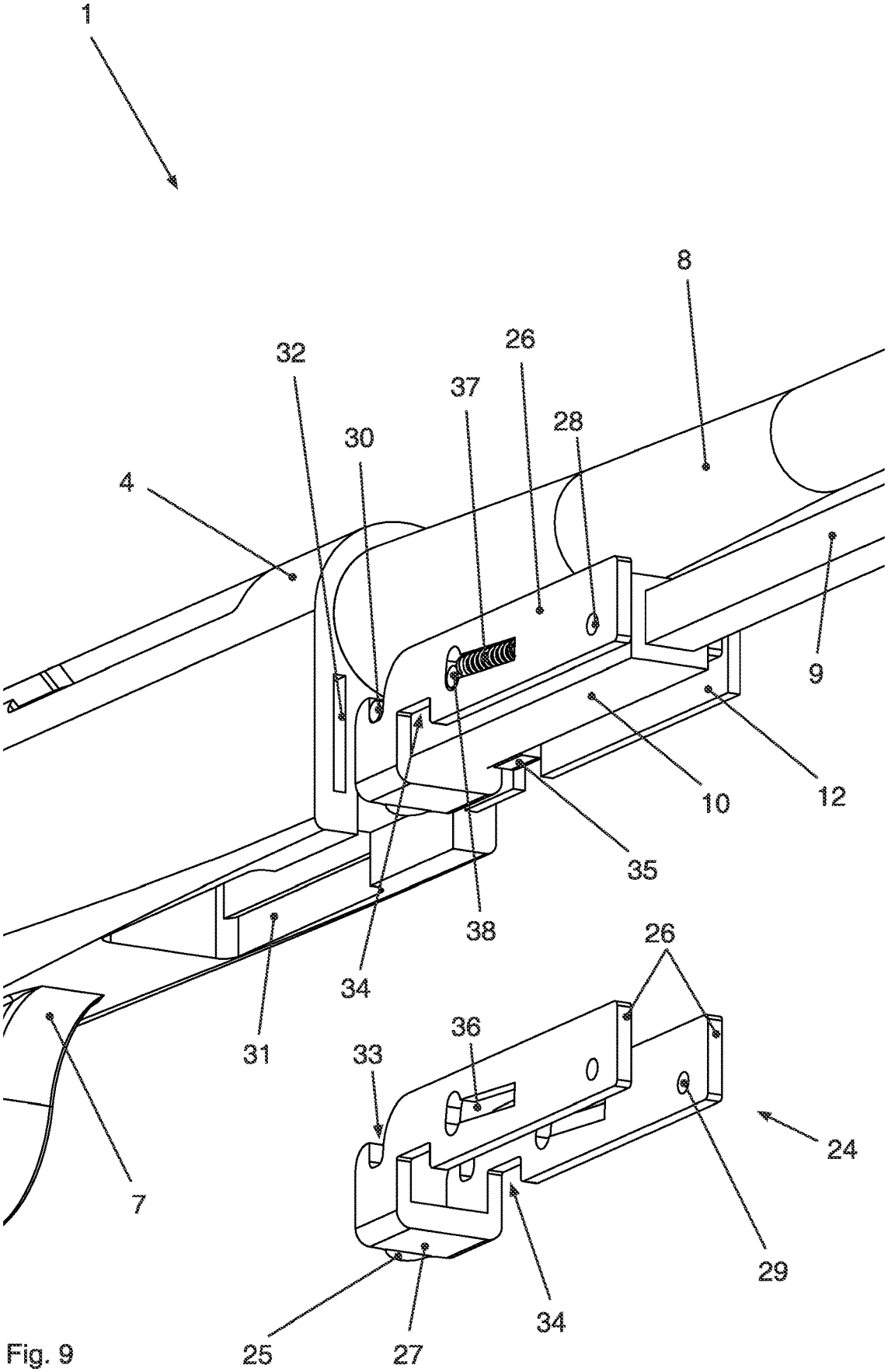
FIG. 9: shows a section from FIG. 2, but with a pendulum switch articulated to the slide as a fork-shaped pivot latch, without an (insertable) cartridge magazine and without a right actuating bar with the slide locked to the longitudinal guide for operation with the bolt handle.
Figure 10:
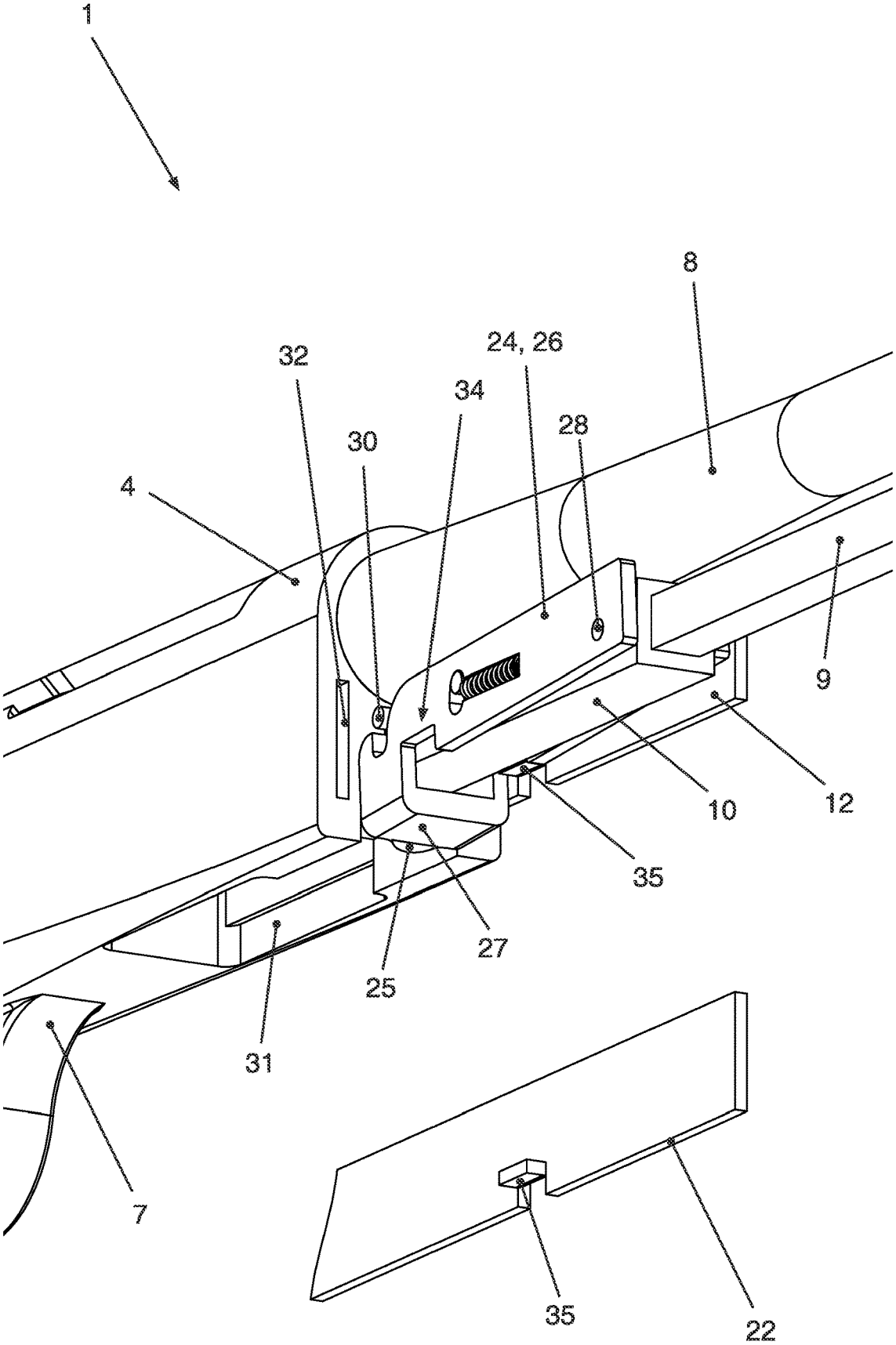
FIG. 10: similar to FIG. 9, with the slide unlocked from the longitudinal guide and with the slide locked to the actuating bar(s) in the operating mode with the forestock.

In a second embodiment of the invention according to FIG. 9 and FIG. 10, the sliding switch 13 or the switching shaft or a pivot mechanism are arranged within the weapon, such that they are not visible from the outside and cannot be operated incorrectly, and after removing the cartridge magazine 6, for example, can be manually switched through the then free magazine well.

In the case of the pivot mechanism configured in this manner, according to FIG. 9, a mirror-symmetrical and fork-shaped pivot latch 24 (which can be considered a pendulum switch 13 and can be produced economically as a punched bent part), is guided with its two latch flanks 26 on bearing pins 28 arranged on the slide 10 on both sides, also mirror-symmetrically, so as to be pivotable about the pin axis transverse to the repeating rifle 1. For this purpose, the two flanks 26 are provided with two coaxial bearing bores 29.

At their free end, each of the two flanks 26 has a respective gap 33, 34 on both sides in the circumferential direction, wherein the one can come into or out of engagement with, e.g., a sheet metal flap 35 of the actuating bars(s) 12 and the other one with a projection or a recess of the buttstock-housing-barrel-longitudinal guide-assembly 3, 4, 8, 9. For this purpose, FIG. 9 shows a locking bolt 30 projecting transversely out of the rectangular rod 9 mirror-symmetrically on both sides, the two ends of which are laterally in engagement with the two gaps 33 of the pivot latch 24, wherein it is structurally preferable if the rear flanks of the gaps 33 abut against the rear outer surfaces of the locking bolts 30 and the slide 10 (including the forestock 2) preferably strikes against the housing 4 in the firing direction. The slide 10, preferably configured as a rectangular tube, is thereby connected to the buttstock-housing-barrel-rectangular rod-assembly 3, 4, 8, 9 in an axially-fixed manner and thus also the forestock 2 that is stationarily attached thereto or optionally formed in one piece therewith. This results in the operating mode by means of the bolt handle 5. During its repeating operation, both actuating bars 12, which are axially coupled to the breechblock in a mirror-symmetrical manner—of which actuating bars 12 only the left one is shown so that the pivot latch 24 becomes visible—oscillate through their shafts 32. The sheet metal flaps 35 bent inwardly in a mirror-symmetrical manner out of the two actuating bars 12 (and out of their bottom sides 22 by forming technology) hereby pass the bottom sides of both latch flanks 26 in an unhindered manner.

When the breechblock is open, the two ends of the locking bolt 30, which can be produced as welding bolts (bolt welded symmetrically on the rectangular rod 9), are mirror-symmetrically opposite one another with their two corresponding gaps 33 and the two sheet metal flaps 35 with their two corresponding gaps 34 in the latch flanks 26. In this position, the pivot latch 24 operable as a pendulum switch 13 can be used to switch between both operating modes in a manual and toolless manner. For this purpose, an operating finger engages through the open magazine well 31 according to FIG. 9 and engages under a handling lip 25, which is arranged on a latch bridge 27 connecting both latch flanks 26. By pressing a finger on the bottom side of the handling lip 25, the pendulum switch 13 jumps from its angular position in FIG. 9 into its other end position according to FIG. 10. Thus, the two gaps 33 in engagement with the two locking bolt ends 30 in FIG. 9 synchronously come out of engagement and the gaps 34, according to FIG. 10, synchronously enter into a positive engagement (in the direction of the direction of movement of the slide 10) with the two mirror-symmetrical sheet metal flaps 35 of the two actuating bars 12. This results in the operating mode as a pump action repeater with the following flow of force: forestock 2→slide 10→bearing pin 28→bearing bores 29→latch flanks 26→gaps 34→sheet metal flaps 35→actuating bars 12→breechblock.

To switch to the previous operating mode with the bolt handle 5, when the breechblock is open and the cartridge magazine 6 is removed, the pivot latch 24 must be pressed back into its original end position through the magazine well 31 by pressing a finger on the latch bridge 27, in which end position the two gaps 33 of the two flanks 26 again synchronously engage around the two locking bolt ends 30.

The pivot latch 24 snaps in a haptically perceptible manner into both end positions, in which it remains securely. This is achieved by a catch, which consists of at least one catch pin 38 arranged transversely on the slide 10, on the outside face of which catch pin 38 a ball rests that is acted upon by a catch compression spring 37. All catch elements are arranged in a respective, preferably congruent, perforation 36 of the latch flanks 26, which is covered inwards by the slide 10 and outwards by the respective actuating rod 12. Thus, they are enclosed securely in a sandwich-like manner in the latch flank(s) 26 between the actuating bar(s) and the side face(s) of the slide 10.

The pendulum switch 24 is to be understood mechanically as a single-arm lever with a pivot axis about the axis of its bearing pins 28. To operate it, the latch bridge 27 must be pressed or the handling lip 25 must be pulled (up). It may be economically advantageous if the switch 13, 24 is operable only by pressure. To achieve this, the pendulum switch must become a rocker switch 13. This is achieved by extending at least one latch flank 26 in the firing direction, whereby a two-armed lever would be created, the two ends of which could be operated by manual pressure through the forestock 2.

Another type of construction not graphically illustrated here comprises a pivot mechanism, also arranged on the slide 10, the axis of rotation of which extends substantially in parallel to the barrel axis and which is rotatably mounted on the slide 10 or forestock 2 in an axially-fixed manner. The end of the pivot mechanism accessible through the magazine well has a claw coupling configured as a rocker switch, which claw coupling in its one angular end position comes into or out of engagement with the housing-barrel-longitudinal guide-assembly 4, 8, 9 and in its other angular end position with the breechblock-actuating bar(s)-assembly 12.

The embodiments described above can be continued in a variety of variants. In order to fulfill the goal of the invention, all have in common the mechanical function that on the buttstock-housing-barrel-longitudinal guide-assembly 3, 4, 8, 9 both the forestock-slide-assembly 2, 10 and the breechblock-actuating bar(s)-assembly 12 are guided substantially in parallel to the barrel axis and independently of one another, wherein, in accordance with the invention, the first is coupleable to the second assembly in a toolless manner, such that the third assembly is then repeatable by means of the bolt handle 5, or the second is coupleable to the third assembly in a toolless manner, such that the repeating firearm 1 is repeated by means of the forestock 2.

In another embodiment, which is also not graphically illustrated here, the forestock 2 is decoupled from the slide 10 and is guided separately on the longitudinal guide 9 in an axially movable manner. Both elements are force-coupled by way of a reversing gear, so that they move axially in opposite directions. This design takes aesthetic aspects into account in the operating mode as a pump action repeater, since when the breechblock is closed—i.e. when the weapon is ready to fire—the forestock 2 transitions flush and "seamlessly" into the housing 4.

Another embodiment, also not graphically illustrated, comprises the so-called "bullpup" design. This is a short design of firearms, in which the classic buttstock 2 is omitted and the housing 4 replaces it with an ergonomically designed shoulder system. The subject matter of the invention is predestined for this short design, since the repetition—by means of the forestock 2 or bolt handle 5—is carried out ergonomically comfortably in the front region of the weapon 1 using the actuating bar(s) 12, while the actuating bar(s) 12 ensure the other weapon functions—e.g. loading by means of the movement of the breechblock and tensioning the lock—in the housing 4 in the manner of transfer rails.

All features and advantages arising from the claims, description and drawings, including structural details, arrangements and method sequences, may be relevant to the invention both in themselves and in a variety of combinations.

REFERENCE NUMERAL LIST

1 repeating firearm
2 forestock
3 buttstock
4 housing
5 bolt handle
6 cartridge magazine
7 trigger assembly
8 barrel
9 longitudinal guide/rectangular rod
10 slide
11 guide grooves
12 actuating bar(s)
13 actuating handle/sliding switch
14 gap-like cutout (in actuating bar(s) 12)
15 vertical transverse groove (in rectangular rod 9)
16 (cuboidal) locking projection
17 (groove-like) set-back portion
18 longitudinal perforation (in slide 10)
19 transverse perforation (in slide 10)
20 groove-side locking nose
21 gap-side locking nose
22 lower side face(s) (on actuating bar(s) 12)
23 lower side face (on rectangular bar 9)
24 pendulum switch/pivot latch
25 handling lip (on pivot latch 24)
26 latch flanks
27 latch bridge
28 bearing pin (on slide 10)
29 bearing bore (in flank 26)
30 locking bolts (in longitudinal guide 9)
31 magazine well
32 shaft (for actuating rod(s) 12)
33 gap (for locking bolt 30)

34 gap (for sheet metal flap 35)
35 sheet metal flaps (of the actuating bars 12)
36 perforation (in latch flank(s) 26)
37 catch compression spring (in perforation 36)
38 catch pin (on slide 10)

What is claimed is:

1. A repeating firearm, in particular a repeating rifle, which is configured as a straight-pull bolt action rifle, comprising a forestock and a bolt handle, wherein the repeating firearm is selectively operable either with the forestock or with the bolt handle, wherein a switching between the operation with the forestock and the operation with the bolt handle takes place in a toolless manner by way of at least one actuating handle arranged on or in the repeating firearm, wherein the at least one actuating handle has a two-stage switching mechanism with a first switching state and a second switching state, and wherein the repeating firearm is operable in the first switching state with the forestock and in the second switching state with the bolt handle.

2. The repeating firearm in accordance with claim 1, wherein the actuation of the actuating handle in the first switching state establishes a positive engagement substantially in the direction of the barrel axis between an assembly comprising the forestock and the slide and an assembly comprising the buttstock, the housing, the barrel, and the longitudinal guide and, in the second switching state, establishes a positive engagement between an assembly comprising the forestock and the slide and an assembly comprising the actuating bar(s) with a breechblock coupled thereto in an axially-fixed manner.

3. The repeating firearm in accordance with claim 1, wherein the at least one actuating handle is arranged on or in an assembly comprising the forestock and the slide.

4. The repeating firearm in accordance with claim 1, wherein the actuating handle has or moves locking contours, which during the one switching movement come into engagement with the housing, the barrel, or the longitudinal guide and come out of engagement with the actuating bar(s) or the breechblock, and which during the other switching movement come out of engagement with the housing, the barrel, or the longitudinal guide and come into engagement with the actuating bar(s) or the breechblock.

5. The repeating firearm in accordance with claim 1, wherein the switching mechanism comprises:

a sliding switch, a rocker switch, a toggle switch, a pendulum switch, or a rotary switch;
a longitudinal guide, a barrel, or a housing;
a slide or a forestock; and
at least one actuating bar.

6. The repeating firearm in accordance with claim 1, wherein the switching mechanism comprises:

a switching shaft, a longitudinal guide, a barrel, or a housing;
a slide or a forestock; and
at least one actuating bar.

7. The repeating firearm in accordance with claim 5, wherein the longitudinal guide is stationarily attached to the housing as a cantilever substantially in parallel to the barrel and the slide with the forestock attached thereto is arranged on said longitudinal guide so as to be axially displaceable.

8. The repeating firearm in accordance with any claim 1, wherein the slide is drivable in opposite directions with the forestock.

9. The repeating firearm in accordance with claim 1, wherein the actuating handle is configured as a pivot latch, which is of substantially mirror-symmetrical and fork-like configuration and whose two latch flanks synchronously come into or out of engagement with the two actuating bars or synchronously with the two latching bolts.

10. The repeating firearm in accordance with claim 9, wherein the pivot latch has a latch bridge connecting both latch flanks, on which latch bridge a handling lip is preferably arranged, such that the pivot latch is manually and toollessly operable for switching between the operation with the bolt handle and the operation with the forestock.

11. The repeating firearm in accordance with claim 9, wherein when the cartridge magazine is removed, the pivot latch is manually and toollessly operable through the magazine well for switching between the operation with the bolt handle and the operation with the forestock.

12. The repeating firearm in accordance with claim 9, wherein at least one of the two latch flanks of the pivot latch is extended beyond its pivot axis in the firing direction with the formation of a two-armed lever, both ends of which are operable through the forestock by mechanical application of pressure for switching between the operation with the bolt handle and the operation with the forestock.

* * * * *